US010617194B2

(12) United States Patent
Rogers et al.

(10) Patent No.: US 10,617,194 B2
(45) Date of Patent: Apr. 14, 2020

(54) LOAD ADJUSTMENT SYSTEM FOR BACKPACKS

(71) Applicant: The North Face Apparel Corp., Wilmington, DE (US)

(72) Inventors: Daniel Norris Rogers, Tiburon, CA (US); Christopher Kenji Tagumi, Oakland, CA (US); Ben Guthrie, San Francisco, CA (US)

(73) Assignee: The North Face Apparel Corp., Wilmington, DE (US)

( * ) Notice: Subject to any disclaimer, the term of this patent is extended or adjusted under 35 U.S.C. 154(b) by 85 days.

(21) Appl. No.: 15/427,650

(22) Filed: Feb. 8, 2017

(65) Prior Publication Data

US 2018/0220779 A1 Aug. 9, 2018

(51) Int. Cl.
*A45F 3/00* (2006.01)
*A45F 3/04* (2006.01)
*A45F 3/08* (2006.01)

(52) U.S. Cl.
CPC ..... *A45F 3/047* (2013.01); *A45F 3/04* (2013.01); *A45F 3/08* (2013.01); *A45F 2003/045* (2013.01)

(58) Field of Classification Search
CPC .... A45F 3/047; A45F 3/04; A45F 3/08; A45F 2003/045
USPC ..... 224/631
See application file for complete search history.

(56) References Cited

U.S. PATENT DOCUMENTS 3,957,184 A * 5/1976 Shurman ..... A45F 3/04 224/630
5,184,764 A * 2/1993 Orovan ..... A45F 3/08 224/262
5,497,922 A * 3/1996 Tate ..... A45F 3/04 224/160
6,276,584 B1 * 8/2001 McLachlan ..... A45F 3/04 224/262
6,802,442 B1 * 10/2004 Thompson ..... A44B 11/14 224/259
7,287,677 B2 * 10/2007 Reid ..... A45F 3/047 224/628
8,172,117 B2 * 5/2012 Maggi ..... A45F 3/047 224/263
8,672,203 B2 * 3/2014 Staudecker ..... A45F 3/047 224/631
2002/0104862 A1 * 8/2002 Dexheimer ..... A45F 3/04 224/637

(Continued)

*Primary Examiner* — Peter N Helvey
(74) *Attorney, Agent, or Firm* — Hunton Andrews Kurth LLP

(57) ABSTRACT

A backpack with an improved load adjustment system includes a body, a frame, a pair of shoulder straps, a load lifting strap extending from each of the first shoulder strap and the second shoulder strap and suspended by the frame, a yoke attached to the first shoulder strap and the second shoulder strap, a back panel attached to a hip belt having a first hip pad and a second hip pad, and a torso length adjustment strap extending from a first lower side portion of the frame to a second lower side portion of the frame opposite the first lower side portion of the frame and passing through a strap receiving member fixed to the yoke. The improved load adjustment system allows for quick adjustment while wearing the backpack and increased freedom of movement.

20 Claims, 9 Drawing Sheets

(56) References Cited

U.S. PATENT DOCUMENTS

| | | | | |
|---|---|---|---|---|
| 2002/0170932 | A1* | 11/2002 | Higgins | A45F 3/04 224/156 |
| 2005/0082330 | A1* | 4/2005 | Fehlberg | A45F 3/047 224/631 |
| 2006/0131355 | A1* | 6/2006 | Tate | A45F 3/047 224/637 |
| 2006/0138188 | A1* | 6/2006 | Kramer | A45F 3/08 224/581 |
| 2006/0289589 | A1* | 12/2006 | Gregory | A45F 3/047 224/631 |
| 2008/0197163 | A1* | 8/2008 | Yip | A45F 3/047 224/635 |
| 2009/0127301 | A1* | 5/2009 | Fidrych | A45F 3/047 224/197 |
| 2010/0230458 | A1* | 9/2010 | Kramer | A45F 3/08 224/581 |
| 2010/0270348 | A1* | 10/2010 | Demskey | A45F 3/14 224/576 |
| 2013/0087589 | A1* | 4/2013 | Gleason, Jr. | A45F 3/08 224/149 |

* cited by examiner

LOAD ADJUSTMENT SYSTEM FOR BACKPACKS

TECHNICAL FIELD

The present invention generally relates to backpacks, which can be used for travelling, or in a wide range of outdoor activities, such as hiking, camping, fishing, and the like.

BACKGROUND

Backpacks allow users to carry items by distributing the load across the users' shoulders and back. Typically, a backpack is held on a user's shoulders by shoulder straps, through which the user inserts her arms. A backpack may also include a hip belt to further secure the load, preventing excessive rotation on the user's back. Carrying cargo in a backpack can be a comfortable alternative to hand-carrying.

Due to varying body types and postures among users of backpacks, simple adjustability of a backpack's shoulder straps and hip belt are desirable. In order to have shoulder straps that better contour to a user's back and shoulders, some backpacks include load-stabilizing straps attached to the shoulder straps and body. However, conventional backpacks often have two individual load-stabilizing straps—one for each shoulder strap—and these load-stabilizing straps are separately adjustable. Therefore, a user must adjust each strap individually and coordinate the settings of each so that the backpack can rest symmetrically on the user's back. Also, separate and independent load-stabilizing straps are unable to function cooperatively to shift the position of the shoulder straps and load in response to a user's movements. User comfort is limited in this respect.

Additionally, some backpacks offer adjustability of the position of the hip belt. However, conventional adjustment mechanisms are difficult to use and may require a user to take off the backpack or partially disassemble the backpack to make an adjustment, especially in cases where a length between shoulder straps and a hip belt is adjusted.

Accordingly, there is a need for an improved load adjustment system for backpacks which allows users to quickly and easily adjust the positions of the shoulder straps and hip belt. There is also a need for such a system which responds to a user's movements.

SUMMARY

One aspect of the present invention relates to backpacks with a load lifting mechanism for adjusting the position of the shoulder straps and allowing variable distribution of the load across a user's shoulders. One example of such a backpack may include a body, a frame, a first shoulder strap, a second shoulder strap, and a load lifting strap extending from each of the pair of shoulder straps and suspended by the frame.

In one embodiment, the backpack may also include a fastener fixed to the first shoulder strap which selectively fastens the load lifting strap and a fixation point which fixes an end of the load lifting strap to the second shoulder strap.

In another embodiment, the backpack may include a first fastener fixed to the first shoulder strap which selectively fastens the load lifting strap, and a second fastener fixed to the second shoulder strap which selectively fastens the load lifting strap.

Still another embodiment may include a pair of notches located in a top portion of the frame which direct the load lifting strap behind the frame.

Another aspect of the present invention relates to a torso length adjustment mechanism for adjusting the distance between a hip belt and shoulder straps of a backpack for increased comfort and improved security of a backpack on the user. An example of such a backpack may include a body, a frame, a first shoulder strap, a second shoulder strap, a yoke attached to the first shoulder strap and the second shoulder strap, a back panel attached to a hip belt having a first hip pad and a second hip pad, and a torso length adjustment strap extending from a first lower side portion of the frame to a second lower side portion of the frame opposite the first lower side portion of the frame and passing through a strap receiving member fixed to the yoke.

In one embodiment, the backpack may include a fastener fixed to the first lower side portion of the frame which selectively fastens the torso length adjustment strap, and a fixation point which fixes an end of the torso length adjustment strap to the second lower side portion of the frame.

In another embodiment, the backpack may include a first fastener fixed to the first lower side portion of the frame which selectively fastens the torso length adjustment strap and a second fastener fixed to the second lower side portion of the frame which selectively fastens the torso length adjustment strap.

In still another embodiment, the yoke may be mated to the frame so as to be slidable along vertical portions of the frame in response to adjustment of the torso length adjustment strap.

In still another embodiment, the back panel may be mated to the frame so as to be slidable along vertical portions of the frame in response to adjustment of the torso length adjustment strap.

In still another embodiment, the back panel may conceal the torso length adjustment strap.

Further, a backpack in accordance with the present invention may include both a load lifting mechanism and a torso length adjustment mechanism. An example of such a backpack may include a body, a frame, a first shoulder strap, a second shoulder strap, a load lifting strap attached to each of the first shoulder strap and second shoulder strap and suspended by the frame, a yoke attached to the first shoulder strap and the second shoulder strap, a back panel attached to a hip belt having a first hip pad and a second hip pad; and, a torso length adjustment strap extending from a first lower side portion of the frame to a second lower side portion of the frame opposite the first lower side portion of the frame and passing through a strap receiving member fixed to the yoke.

BRIEF DESCRIPTION OF THE DRAWINGS

The present invention will become more fully understood from the detailed description given below and from the accompanying drawings. The drawings are intended to disclose but a few possible examples of the present invention, and thus do not limit the present invention's scope.

DETAILED DESCRIPTION

The present invention generally relates to an improved load adjustment system for backpacks. While preferred examples of the load adjustment system is described in detail below in conjunction with a backpack, the load adjustment system described herein may also be applied to a broad variety of apparatuses such as safety vests and safety harnesses.

Figure 1:
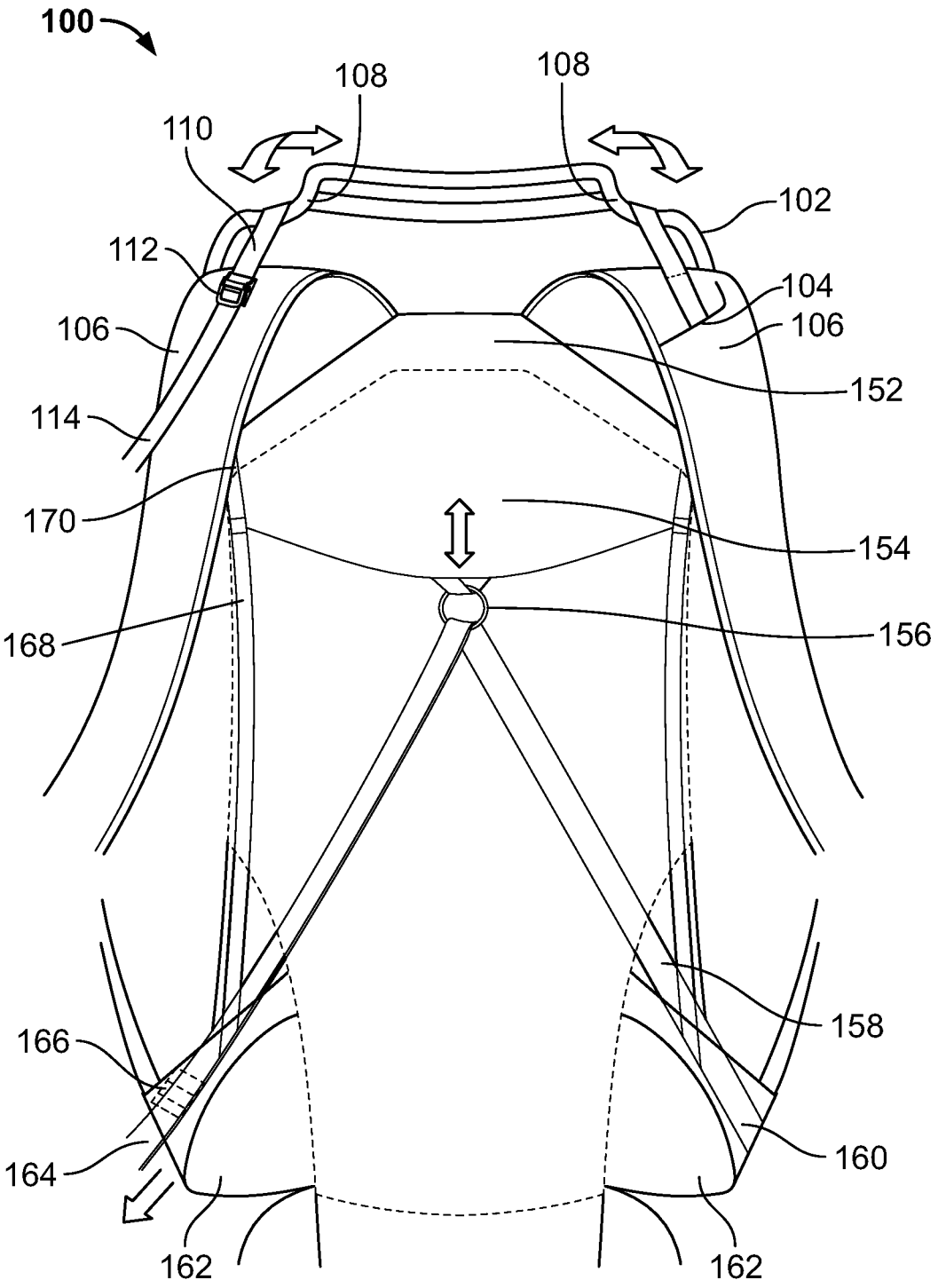
FIG. 1 shows a schematic diagram of a backpack with a load adjustment system in accordance with the present invention.

One example embodiment of the load adjustment system of the present invention is shown schematically in FIG. 1. The load lifting mechanism of the present invention will first be described. The torso length adjustment mechanism will be described thereafter.

The assembly 100 in FIG. 1 includes a frame 102 which is provided to maintain the shape of a body of backpack (not shown), and support certain components, among other functions. The frame 102 may be made from a rigid, elongate material such as tubular aluminum, for example. The frame 102 includes vertical portions on each side of the assembly 100 which extend substantially vertically along the sides of the assembly 100. The side portions of the frame 102 are connected at their top ends by a top portion of the frame 102.

The top portion of the frame 102 includes notches 108. The notches 108 are formed by bends in the frame 102 and are preferably located toward the outer ends of the top portion of the frame 102. The notches 108 are preferably wide enough to accommodate a strap of a type commonly associated with backpacks laid across them. The notches 108 therefore may be between ¼ inch to 4 inches, for example. Each notch 108 includes a portion that is angled relative to the top portion so as to redirect a load lifting strap 110 extending from a downward direction toward the other notch 108.

The assembly 100 further includes shoulder straps 106. The shoulder straps 106 are attached to a yoke 152 and extend upward from the yoke 152. The shoulder straps 106 are contoured in an ordinary way so as to comfortably rest on the user's shoulders.

The assembly 100 further includes the load lifting strap 110. The load lifting strap 110 is preferably fixedly attached to one of the shoulder straps 106 at a fixation point 104. The load lifting strap 110 may be fixedly attached to one of the shoulder straps 106 by sewing, adhesive, or another suitable method. The load lifting strap 110 is preferably held to the other of the shoulder straps 106 by a fastener 112 such that it can be selectively fastened by the user. The fastener 112 may be a cam buckle, for example. Between the shoulder straps, the load lifting strap 110 extends behind the frame 102 relative to the shoulder straps 106. The load lifting strap 110 is laid over the notches 108 so as to be biased to a position within the notches 108. When the load lifting strap 110 is laid across one of the notches 108, the strap is biased to remain in position within the notch 108 rather than freely moving. The notches 108 redirect the load lifting strap 110 so as to pass behind the frame 102.

In an alternative embodiment, the load lifting strap 110 may be otherwise suspended by the frame 102 by, for example, rings attached to the frame 102 through which the load lifting strap 110 passes.

By orienting the load lifting strap 110 in this way, the load lifting strap 110 uses the rigidity of the frame 102 to apply tension to the shoulder straps 106 in both upward and backward directions from the user. To adjust the position of the shoulder straps 106, the user changes the position of the load lifting strap 110 with respect to the fastener 112. To move the shoulder straps 106 upward, the user may release the fastener 112 and pulls the load lifting strap 110 by its free end 114 so as to shorten a length of the load lifting strap 110 between the fastener 112 and the fixation point 104. The user then engages the fastener 112 to hold the position of the load lifting strap 110. To lower the shoulder straps 106, the user releases the fastener 112 and allows the load lifting strap 110 to retract through the fastener 112, thus increasing the length of the load lifting strap 110 between the fastener 112 and the fixation point 104.

With such a configuration, the user is able to adjust the position of the shoulder straps 106 using only one hand. This allows the user to make adjustments during activities such as hiking while the assembly 100 is worn.

In an alternative embodiment, fixation point 104 could be replaced by a mechanism such as fastener 112, for example. This would allow for the user to choose from which side to make an adjustment. Also, the notches 108 over which the load lifting strap 110 is laid could be replaced by other similar mechanisms such as loops or rings fixed to the body of a backpack.

Using the load lifting strap 110 to apply tension to both of the shoulder straps 106 is advantageous because it improves responsiveness to the user's movements. The load lifting strap 110 is laid over the notches 108 of the frame 102. While the notches 108 restrict the movement of the load lifting strap 110 in a direction lateral to the frame 102, the load lifting strap 110 is able to slide transversely within the notches. As a result, if one of the shoulder straps 106 is lifted, relieving the tension in the load lifting strap 110, the other of the shoulder straps 106 is lowered.

Figure 2:
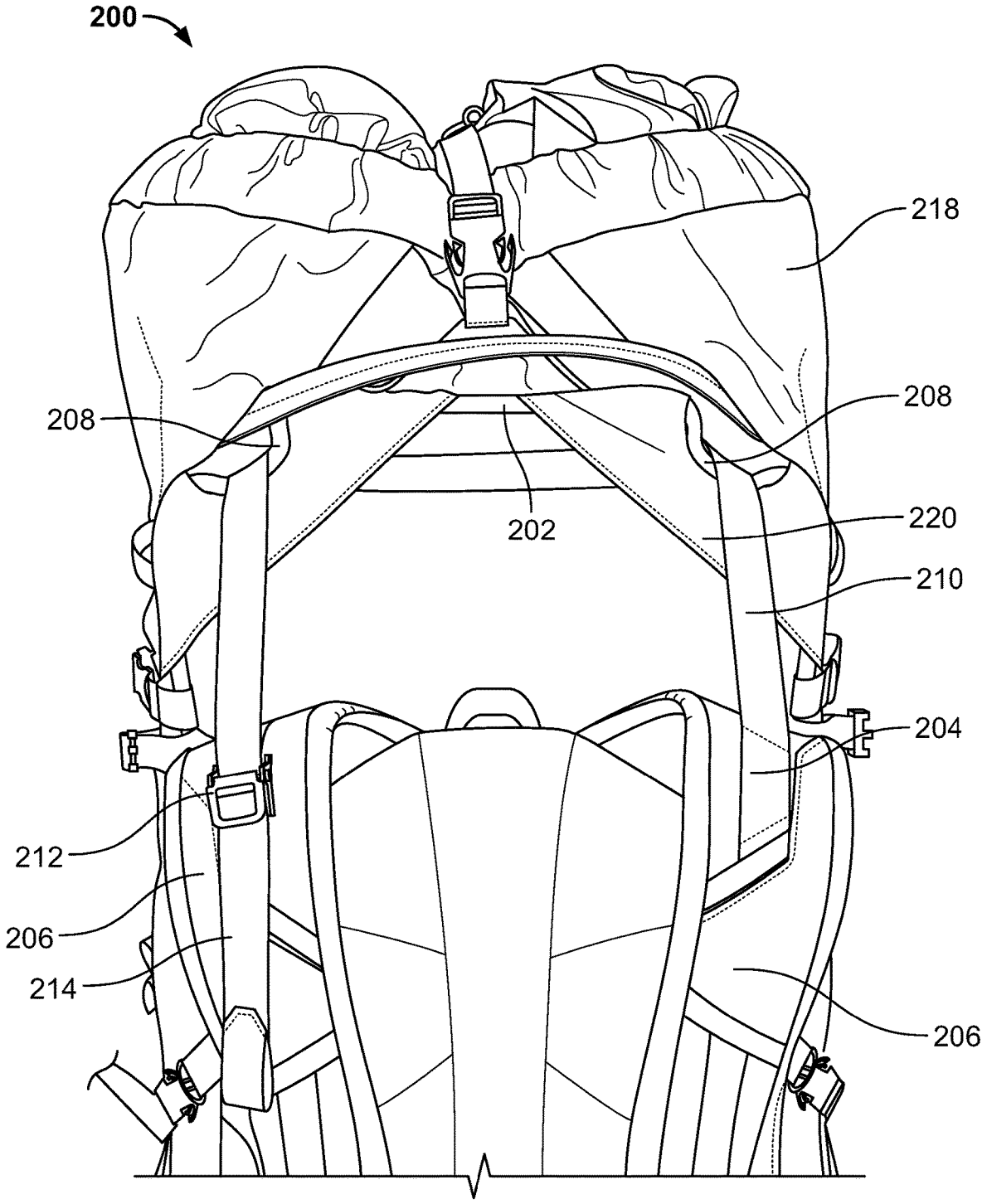
FIG. 2 shows an example configuration of a load lifting mechanism in accordance with the present invention.
Figure 3:
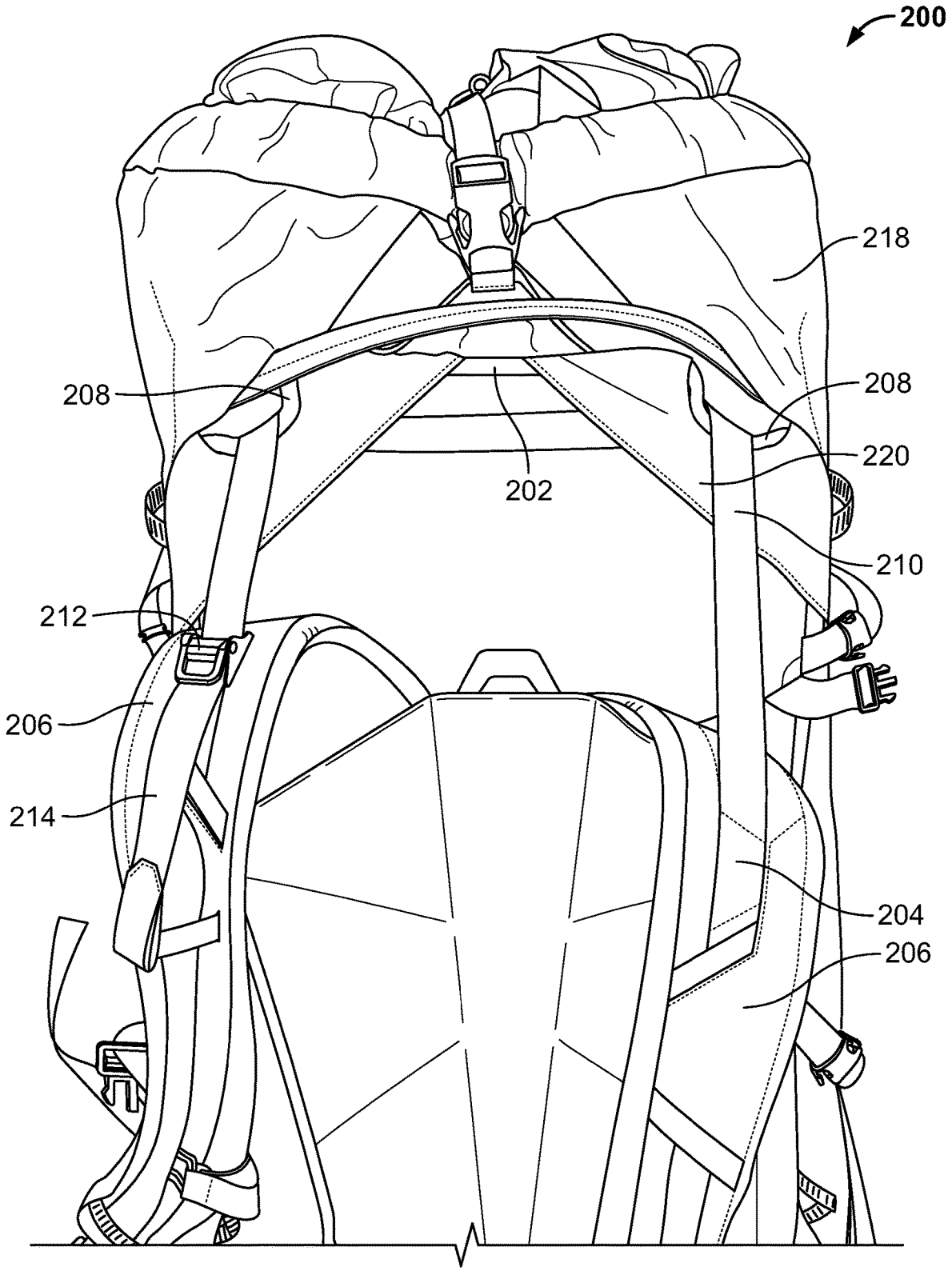
FIG. 3 shows an example configuration of a load lifting mechanism in accordance with the present invention.
Figure 4:
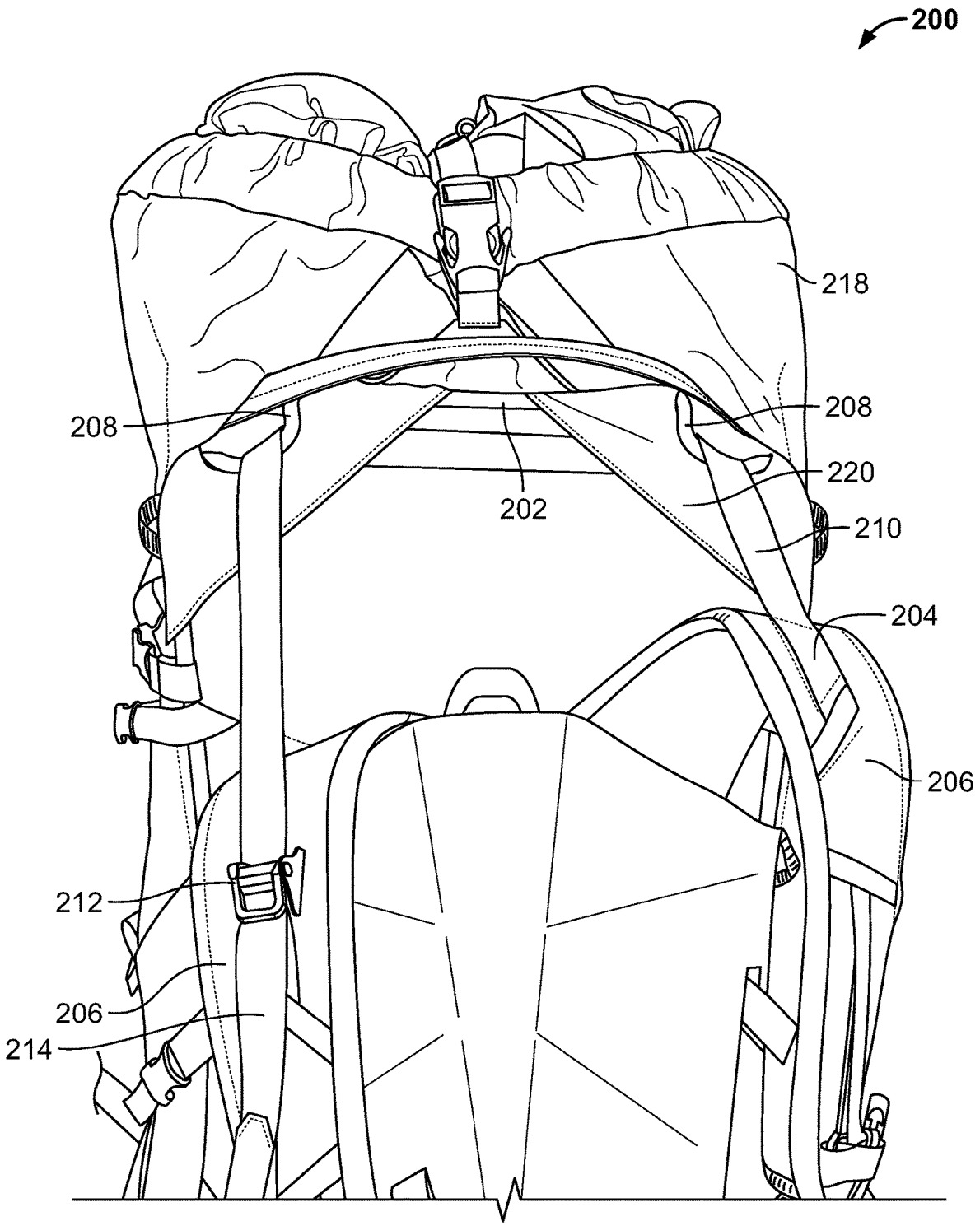
FIG. 4 shows an example configuration of a load lifting mechanism in accordance with the present invention.

FIGS. 2-4 illustrate this coordinated movement of the shoulder straps by a load lifting mechanism in accordance with the present invention as implemented on a backpack 200. In FIG. 2, the fastener 212 is locked so as to set the length of the load lifting strap 210 between fixation point 204 and fastener 212. The shoulder straps 206 are suspended by the load lifting strap 210 at an even height.

In FIG. 3, the shoulder strap 206 on the right side of the image has been lowered. As a result, the load lifting strap 210 is pulled through the notches 208 toward the lowered shoulder strap 206. To account for the shift in the load lifting strap 210, the shoulder strap 206 on the left side of the image is raised. FIG. 4 depicts a similar situation with the positions of the shoulder straps 206 reversed.

The use of a single load lifting strap allows the shoulder straps to better respond to the user's movements. During activities which require raising of the user's arms in an alternating manner, such as climbing a ladder for example, the load lifting strap shifts within the notches which consequently raises and lowers the shoulder straps. Therefore, the weight of the load is not concentrated on one of the user's shoulders and comfort is promoted.

Next, a torso length adjustment mechanism in accordance with the present invention is explained. Referring back to FIG. 1, yoke 152 is mounted so as to be slidable on the frame 102 at attachment points 170. Attachment points 170 may be hollow channels located at the sides of the yoke 152 through which the frame 102 passes. Yoke 152 is thus restrained in forward-backward and side-to-side directions, but able to translate up and down along the frame 102.

Assembly 100 also includes a back panel 154 which preferably is oriented between yoke 152 and the user. Back panel 154 is also mounted on the frame 102 at attachment points 168. Attachment points 168 may be hollow channels at the sides of back panel 154 through which the frame 102 passes. Preferably, back panel 154 is not free to move in any direction with respect to the frame 102. Hip pads 162 are preferably attached to back panel 154 and are located at the lower sides of the assembly 100.

Assembly 100 further includes a torso length adjustment strap 158 for adjusting the distance between the shoulder straps 106 and the hip pads 162. The torso length adjustment strap 158 is preferably fixed at a lower side portion of the frame 102, either to the frame 102 itself or a panel extending from the lower side portion of the frame 102, at fixation point 160 where it is attached by sewing, adhesive, or another suitable method. From the fixation point 160, the torso length adjustment strap 158 passes through a strap receiving member 156 attached to a lower portion of the yoke 152. The strap receiving member 156 may be a ring, for example. The torso length adjustment strap 158 then passes to a fastener 166 fixed at a lower side portion of the frame 102, either to the frame 102 itself or a panel extending from the lower side portion of the frame 102, opposite the fixation point 160. The faster 166 may be a cam buckle, for example.

When the user pulls on free end 164 of the torso length adjustment strap 158, tension is increased in the torso length adjustment strap 158. When tension is increased, the torso length adjustment strap 158 slides through the strap receiving member 156 toward the fastener 166 and a length of the torso length adjustment strap 158 between the fixation point 160 and the fastener 166 is decreased. When this length is decreased, the vertical distance between the strap receiving member 156 and the hip pads 162 decreases. In this process, yoke 152 is pulled downward by the strap receiving member 156 and slides along the vertical portions of the frame 102 to a lower position closer to the hip pads 162. When the user has pulled the free end 164 such that the yoke 152 and shoulder straps 106 are at a comfortable position, the fastener 166 may be engaged to retain the torso length adjustment strap 158 in that position.

In an alternative embodiment, fixation point 160 may be replaced by a second fastener such as a cam buckle so that the torso length adjustment strap 158 is adjustable on either side of the wearer.

Conversely, if the user wishes to increase the distance between the shoulder straps 106 and the hip pads 162, the fastener 166 is disengaged and tension is released in the torso length adjustment strap 158. As a result, the torso length adjustment strap 158 is permitted to slide through the strap receiving member 156 in the opposite direction, thus increasing the length of the torso length adjustment strap 158 between the fixation point 160 and the fastener 166. The torso length adjustment strap 158 would slide in this way and the yoke 152 would slide upward along the vertical portions of the frame 102 when, for example, the user is wearing the assembly and gravity urges the assembly 100 downward while the user's shoulders apply upward force to the shoulder straps 106. When the user has pulled the free end 164 such that the yoke 152 and shoulder straps 106 are at a comfortable position, the fastener 166 may be engaged to retain the torso length adjustment strap 158 in that position.

In an alternative embodiment, the back panel 154 may be mounted so as to be slidable on the frame 102 and the yoke 152 may be fixed to the frame 102. In such a configuration, adjustment of the torso length adjustment strap 158 would cause the back panel 154 to shift along the vertical portions of the frame 102 to move the hip pads 162 either closer or away from the shoulder straps 106. Thus, the back panel 154 would be slidable relative to the frame 102 while the yoke 152 would be stationary relative to the frame 102.

Figure 5:
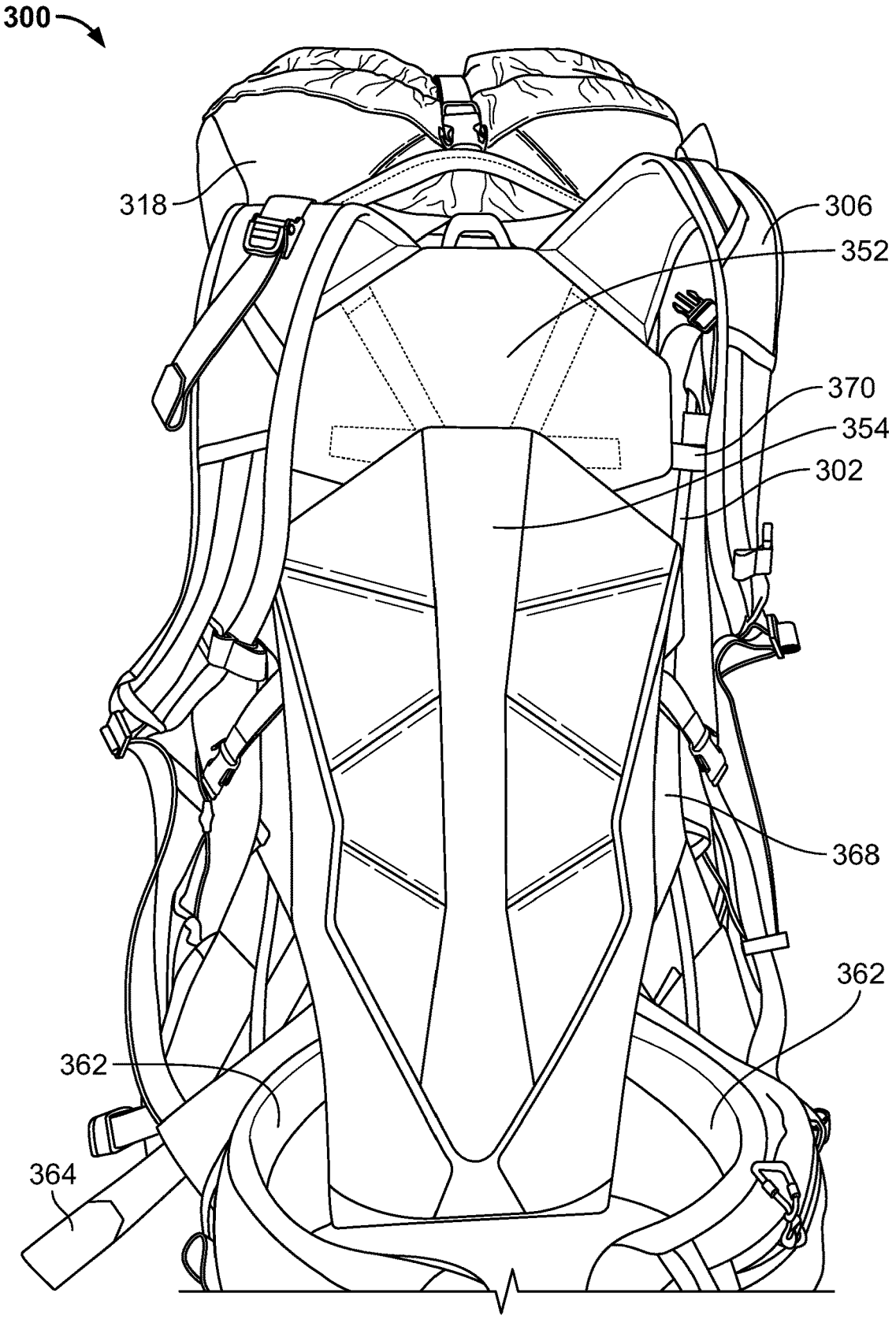
FIG. 5 shows an example configuration of a torso length adjustment mechanism in accordance with the present invention.

FIGS. 5-9 illustrate the implementation of a torso length adjustment mechanism in accordance with the present invention on a backpack 300. In FIG. 5, backpack 300 is shown in a state in which the length of the torso length adjustment strap (shown in FIG. 1 by reference numeral 158) between the fixation point (shown in FIG. 1 by reference numeral 160) and the fastener (shown in FIG. 1 by reference numeral 166) is maximized. In this state, free end 364 is shortest in length. Also in this state, the yoke 352 is permitted to travel to a top most position along the vertical portions of the frame 302 when forced upward by the user's shoulders while the remainder of the backpack 300 is forced downward by gravity. Thus, the distance between the hip pads 362 and the shoulder pads 306 is maximized.

Figure 6:
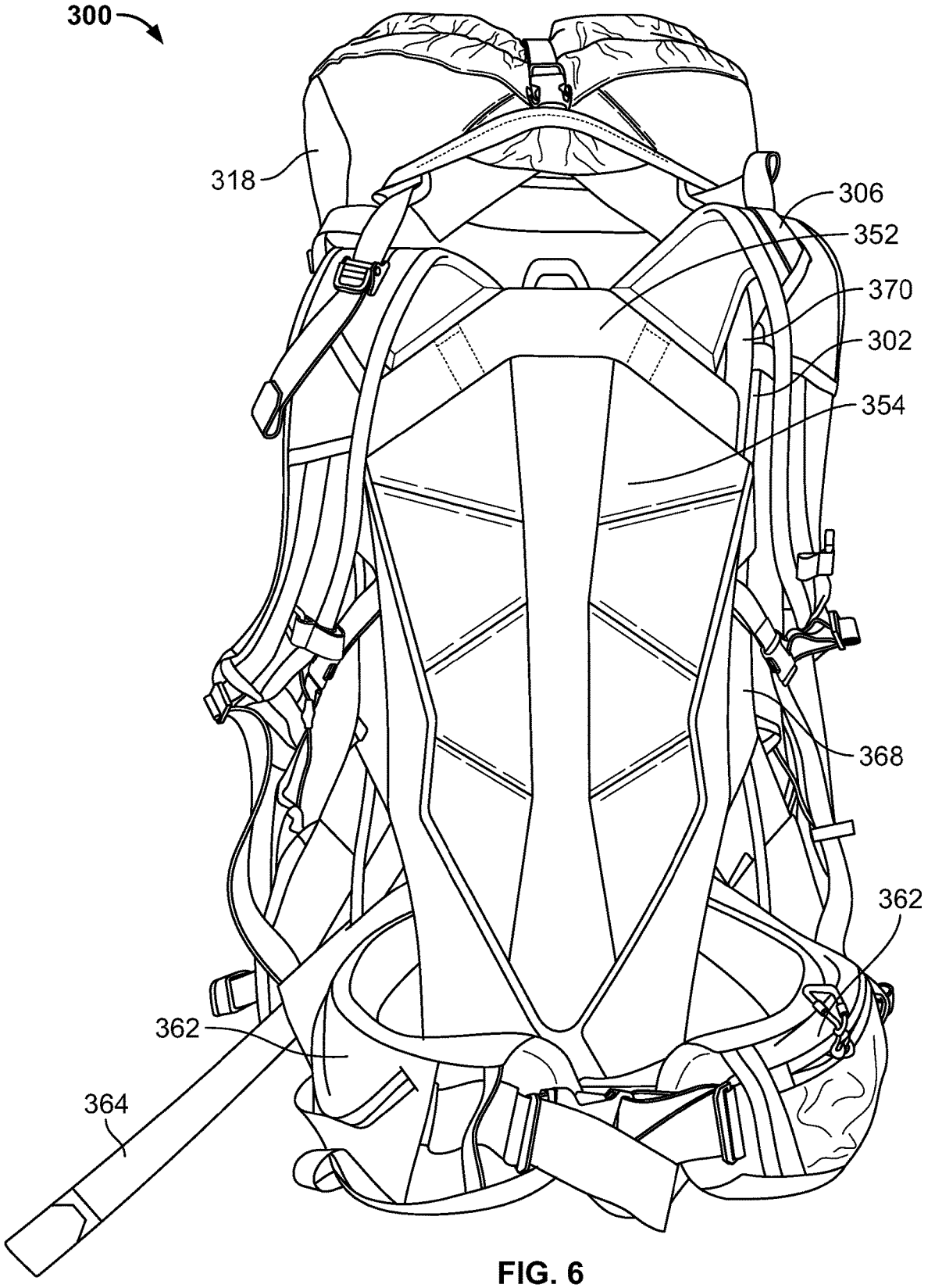
FIG. 6 shows an example configuration of a torso length adjustment mechanism in accordance with the present invention.

In FIG. 6, backpack 300 is shown in a state in which the length of the torso length adjustment strap (shown in FIG. 1 by reference numeral 158) between the fixation point (shown in FIG. 1 by reference numeral 160) and the fastener (shown in FIG. 1 by reference numeral 166) is an intermediate length. In this state, free end 364 is also at an intermediate length. In this state, the yoke 352 is restrained to an intermediate position along the vertical portions of the frame 302 by tension in the torso length adjustment strap 358. Thus, the distance between the hip pads 362 and the shoulder pads 306 is an intermediate distance.

Figure 7:
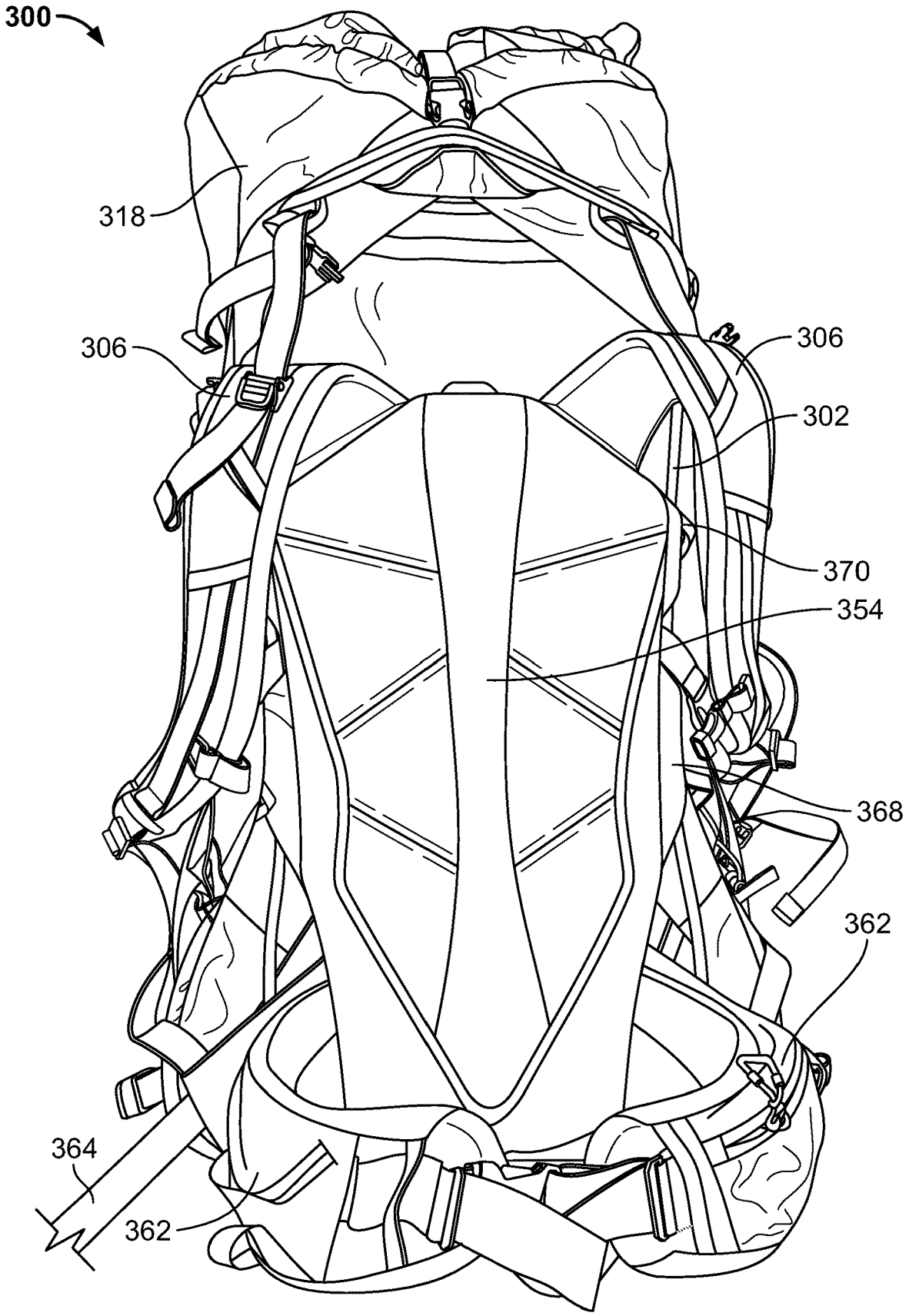
FIG. 7 shows an example configuration of a torso length adjustment mechanism in accordance with the present invention.

In FIG. 7, backpack 300 is shown in a state in which the length of the torso length adjustment strap (shown in FIG. 1 by reference numeral 158) between the fixation point (shown in FIG. 1 by reference numeral 160) and the fastener (shown in FIG. 1 by reference numeral 166) is minimized. In this state, free end 364 is longest in length. Also in this state, the yoke 352 is forced to a bottom most position along the vertical portions of the frame 302 due to the tension in the torso length adjustment strap 358. Thus, the distance between the hip pads 362 and the shoulder pads 306 is minimized. In this state, the yoke 352 may be located substantially behind the back panel 354 with respect to the user. Further, the attachment points 370 of the yoke 352 may nest within the attachment points of the back panel 354, or vice versa.

Figure 8:
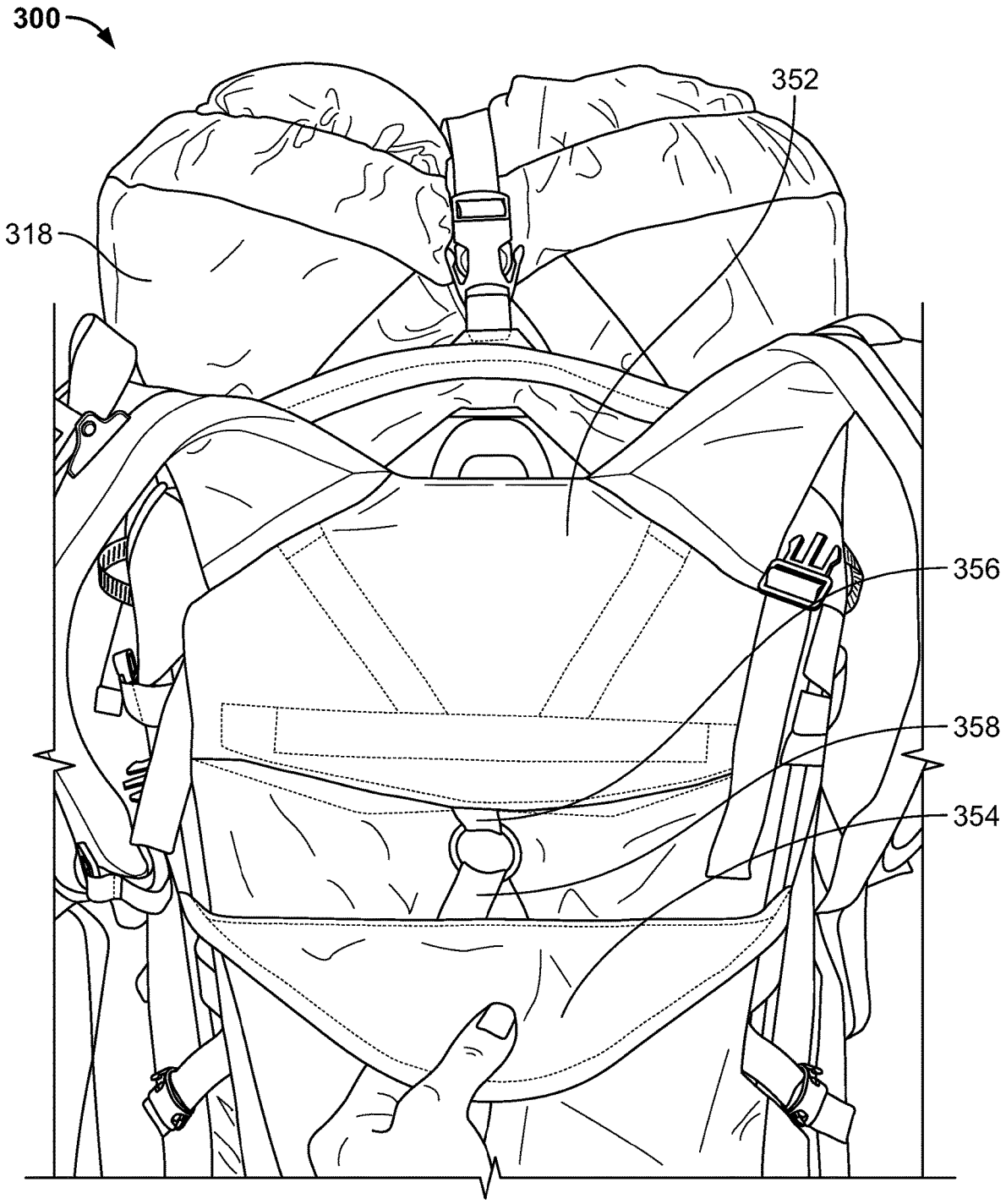
FIG. 8 shows a side view of an example configuration of a torso length adjustment mechanism in accordance with the present invention.

FIG. 8 shows the backpack 300 with a top portion of the back panel 354 folded down to expose components of the torso length adjustment mechanism. The back panel 354 preferably conceals the strap receiving member 356 and the torso length adjustment strap 358 so that neither the strap receiving member 356 nor the torso length adjustment strap 358 rubs against, or binds with, the user's clothing.

Figure 9:
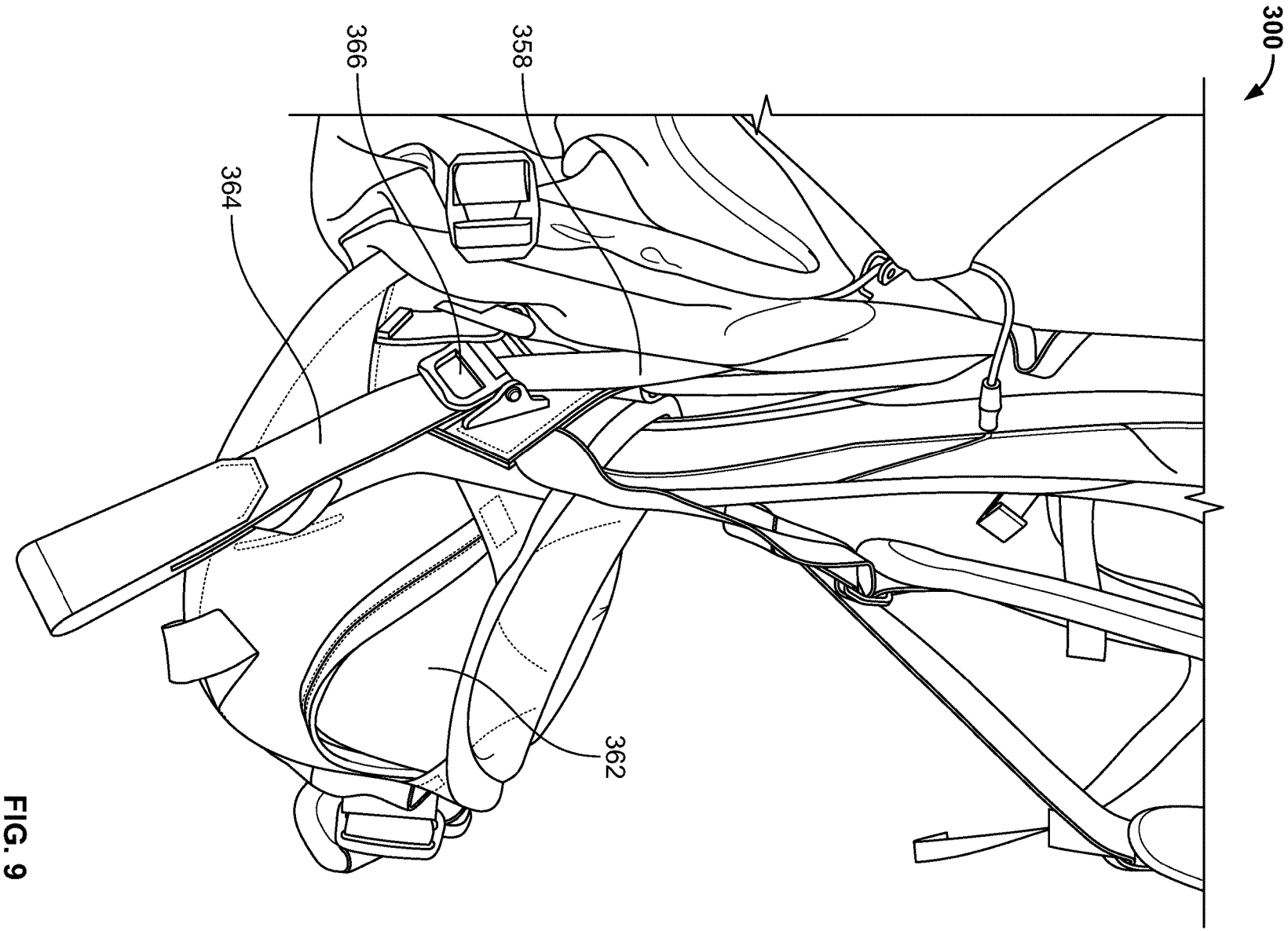
FIG. 9 shows a side view of an example configuration of a torso length adjustment mechanism in accordance with the present invention.

FIG. 9 shows a side view of backpack 300. Torso length adjustment strap 358 extends from behind the back panel 354 to the outside of the right hip pad 362 where it passes through fastener 366. As a result, free end 364 is easily accessible to the user's right hand so that it may be pulled and lengthened or permitted to recede while the user is wearing the backpack 300.

In sum, the torso length adjustment mechanism provides the user of a backpack or other wearable apparatus implementing the mechanism with the ability to easily and conveniently adjust the position of hip pads or a hip belt provided on the backpack. By pulling on the free end of the torso length adjustment strap, with one hand the user can decrease the distance between the shoulder straps and the hip belt. A shorter user, for example, may perform this procedure. By releasing a fastener holding the torso length adjustment strap, with one hand the user can increase the distance between the shoulder straps and the hip belt. A taller user, for example may perform this procedure. Adjustment of the hip belt relative to the shoulder straps increases comfort and safety when carrying loads in the backpack. The user need not remove the backpack or otherwise cease activity to perform the adjustment.

While various embodiments have been described, other embodiments are plausible. It should be understood that the foregoing descriptions of various examples of a backpack with improved shoulder straps are not intended to be limiting, and any number of modifications, combinations, and alternatives of the examples may be employed.

The examples described herein are merely illustrative, as numerous other embodiments may be implemented without departing from the spirit and scope of the present invention. Moreover, while certain features of the invention may be described above only in the context of certain examples or configurations, these features may be exchanged, added, and removed from and between the various embodiments or configurations while remaining within the scope of the invention.

We claim:

1. A backpack comprising:
a body;
a frame;
a first shoulder strap;
a second shoulder strap;
a pair of notches formed by bends in the frame; and
a load lifting strap extending from each of the pair of shoulder straps and suspended by the frame, wherein
the load lifting strap is laid over the notches so as to be biased to a position within the notches.

2. The backpack of claim 1, further comprising:
a fastener fixed to the first shoulder strap which selectively fastens the load lifting strap; and
a fixation point which fixes an end of the load lifting strap to the second shoulder strap.

3. The backpack of claim 1, further comprising:
a first fastener fixed to the first shoulder strap which selectively fastens the load lifting strap; and
a second fastener fixed to the second shoulder strap which selectively fastens the load lifting strap.

4. The backpack of claim 1, wherein the pair of notches is located in a top portion of the frame which direct the load lifting strap behind the frame.

5. The backpack of claim 4, wherein the load lifting strap is slidable through the pair of notches.

6. A backpack comprising:
a body;
a frame;
a first shoulder strap;
a second shoulder strap;
a yoke mounted to the first shoulder strap and the second shoulder strap and being slidable on the frame at attachment points;
a back panel attached to a hip belt having a first hip pad and a second hip pad; and
a torso length adjustment strap extending from a first lower side portion of the frame to a second lower side portion of the frame opposite the first lower side portion of the frame and passing through a strap receiving member fixed to the yoke, wherein
the attachment points are hollow channels located at sides of the yoke through which the frame passes.

7. The backpack of claim 6, further comprising:
a fastener fixed to the first lower side portion of the frame which selectively fastens the torso length adjustment strap; and
a fixation point which fixes an end of the torso length adjustment strap to the second lower side portion of the frame.

8. The backpack of claim 6, further comprising:
a first fastener fixed to the first lower side portion of the frame which selectively fastens the torso length adjustment strap; and
a second fastener fixed to the second lower side portion of the frame which selectively fastens the torso length adjustment strap.

9. The backpack of claim 6, wherein the yoke is mated to the frame so as to be slidable along vertical portions of the frame in response to adjustment of the torso length adjustment strap.

10. The backpack of claim 6, wherein the back panel is mated to the frame so as to be slidable along vertical portions of the frame in response to adjustment of the torso length adjustment strap.

11. The backpack of claim 6, wherein the back panel conceals the torso length adjustment strap.

12. A backpack comprising:
a body;
a frame;
a first shoulder strap;
a second shoulder strap;
a load lifting strap extending from each of the first shoulder strap and the second shoulder strap and suspended by the frame;
a yoke mounted to the first shoulder strap and the second shoulder strap and being slidable on the frame at attachment points;
a back panel attached to a hip belt having a first hip pad and a second hip pad; and
a torso length adjustment strap extending from a first lower side portion of the frame to a second lower side portion of the frame opposite the first lower side portion of the frame and passing through a strap receiving member fixed to the yoke, wherein
the attachment points are hollow channels located at sides of the yoke through which the frame passes.

13. The backpack of claim 12, further comprising:
a fastener fixed to the first shoulder strap which selectively fastens the load lifting strap; and
a fixation point which fixes an end of the load lifting strap to the second shoulder strap.

14. The backpack of claim 12, further comprising:
a first fastener fixed to the first shoulder strap which selectively fastens the load lifting strap; and
a second fastener fixed to the second shoulder strap which selectively fastens the load lifting strap.

15. The backpack of claim 12, further comprising:

a pair of notches located in a top portion of the frame which direct the load lifting strap behind the frame.

16. The backpack of claim 15, wherein the load lifting strap is slidable through the pair of notches.

17. The backpack of claim 12, further comprising:

a fastener fixed to the first lower side portion of the frame which selectively fastens the torso length adjustment strap; and a fixation point which fixes an end of the torso length adjustment strap to the second lower side portion of the frame.

18. The backpack of claim 12, further comprising:

a first fastener fixed to the first lower side portion of the frame which selectively fastens the torso length adjustment strap; and a second fastener fixed to the second lower side portion of the frame which selectively fastens the torso length adjustment strap.

19. The backpack of claim 12, wherein the yoke is mated to the frame so as to be slidable along vertical portions of the frame in response to adjustment of the torso length adjustment strap.

20. The backpack of claim 12, wherein the back panel is mated to the frame so as to be slidable along vertical portions of the frame in response to adjustment of the torso length adjustment strap.

* * * * *